US010002707B2

(12) United States Patent
Tsai et al.

(10) Patent No.: US 10,002,707 B2
(45) Date of Patent: Jun. 19, 2018

(54) INDUCTION COIL STRUCTURE FOR WIRELESS CHARGING DEVICE

(71) Applicant: Fu Da Tong Technology Co., Ltd., New Taipei (TW)

(72) Inventors: Ming-Chiu Tsai, New Taipei (TW); Chi-Che Chan, New Taipei (TW)

(73) Assignee: Fu Da Tong Technology Co., Ltd., New Taipei (TW)

( * ) Notice: Subject to any disclaimer, the term of this patent is extended or adjusted under 35 U.S.C. 154(b) by 205 days.

(21) Appl. No.: 14/835,677

(22) Filed: Aug. 25, 2015

(65) Prior Publication Data

US 2015/0364244 A1 Dec. 17, 2015

(30) Foreign Application Priority Data

Feb. 11, 2015 (TW) ..... 104104594 A

(51) Int. Cl.

| | |
|---|---|
| ***H01F 5/00*** | (2006.01) |
| ***H01F 27/28*** | (2006.01) |
| ***H01F 27/36*** | (2006.01) |
| *H01F 38/14* | (2006.01) |

(52) U.S. Cl.

CPC ..... *H01F 27/365* (2013.01); *H01F 27/2871* (2013.01); *H01F 38/14* (2013.01)

(58) Field of Classification Search

None

See application file for complete search history.

(56) References Cited

U.S. PATENT DOCUMENTS 3,833,872 A * 9/1974 Marcus ..... H01F 27/255 336/183
2014/0176281 A1 6/2014 Jung
2014/0176282 A1 6/2014 Jung

FOREIGN PATENT DOCUMENTS

CN 103915903 A 7/2014
CN 104184217 A 12/2014

* cited by examiner

*Primary Examiner* — Ronald Hinson
(74) *Attorney, Agent, or Firm* — Winston Hsu

(57) ABSTRACT

An induction coil structure for a wireless charger includes at least one first coil, at least one second coil, a first magnetic conductor and a second magnetic conductor. The first coil is disposed in a first layer of an induction coil. The second coil is disposed in a second layer of the induction coil. The first magnetic conductor is located between the first coil and the second coil, wherein a first surface and a second surface of the first magnetic conductor are superposed on the first coil and the second coil, respectively. The second magnetic conductor is superposed on a surface of the second coil that is not superposed on the first magnetic conductor. The first magnetic conductor includes a hole, and a wire for winding the first coil extends from the first layer to the second layer via the hole, to wind the second coil.

6 Claims, 6 Drawing Sheets

INDUCTION COIL STRUCTURE FOR WIRELESS CHARGING DEVICE

BACKGROUND OF THE INVENTION

1. Field of the Invention

The present invention relates to an induction coil structure for a wireless charger, and more particularly, to an induction coil structure with excellent inductance and resistance characteristics for a wireless charger, to improve the performance of the wireless charger.

2. Description of the Prior Art

In an induction type power supply system, a supplying-end device of the power supply system transmits power by oscillating and generating sinusoidal wave on a resonance circuit and the sinusoidal wave transmits power to a receiving-end device of the power supply system. The resonance circuit is composed of a resonance capacitor and a supplying-end coil with inductance characteristics, which are driven by a switch circuit. The receiving-end device also includes a resonance circuit composed of a receiving-end coil and a resonance capacitor, for receiving the power transmitted from the supplying-end device to achieve wireless power transmission.

In general, the resonance circuit is composed of coils and the capacitor connected in series. At the supplying-end device, when power switch signals are inputted to both ends of the resonance circuit (i.e., the full-bridge driving mode) or only one end of the resonance circuit (i.e., the half-bridge driving mode), oscillation may be generated on the resonance circuit. Ideally, both the inductance and the capacitance of the resonance circuit reach infinitely large values so that the DC component and AC component of the power switch signals inputted to the resonance circuit may not result in short circuit between the two ends of the resonance circuit, and the power may thereby be efficiently transmitted to the receiving-end device. Though the capacitors obtained in the market may have enough capacitance values, the inductance value of the coils may vary in magnitude due to the differences in the width, length or winding way of the coils. When the inductance value is too small, the AC component of the power switch signals may pass through the coils directly to result in short circuit. A large instantaneous current may thereby be generated between the resonance circuit and the driving circuit, and the circuits may easily be burnt due to the short circuit phenomenon. In addition, the instantaneous current may produce large ripples on the voltage of the coil signal, which may cause electromagnetic interference (EMI) problems. Furthermore, since currents may pass through the resonance circuit when the resonance circuit operates and the coils of the resonance circuit usually have internal impedance, power loss may be generated when the currents pass through the internal impedance of the coils.

Therefore, current coil designs aim at a higher inductance value and lower resistance value in the coils. The conventional ways of increasing inductance are increasing the winding number of the coils and combining the coils together with the magnetic conductor. The conventional ways of reducing the resistance are using thicker coils and reducing the length of the coils as possible. With the same winding area, the usage of thicker coils limits the winding length of the coils. In such a situation, making a choice between the inductance and the resistance values to obtain a preferable length of coils and designing the winding way of coils to let the coils to effectively work with the magnetic conductor have been the major issues in this art that need to be dealt with.

SUMMARY OF THE INVENTION

It is therefore an objective of the present invention to provide an induction coil structure for a wireless charger to solve the above problem. By utilizing the induction coil structure of the present invention, the inductance value may be significantly increased without affecting the resistance value, or the resistance value may be significantly decreased while the inductance value still remains in a certain level, so that the performance of the induction coil may be enhanced.

The present invention discloses an induction coil structure for a wireless charger. The induction coil structure includes at least one first coil, at least one second coil, a first magnetic conductor and a second magnetic conductor. The at least one first coil is disposed in a first layer of an induction coil. The at least one second coil is disposed in a second layer of the induction coil. The first magnetic conductor is located between the at least one first coil and the at least one second coil, wherein a first surface of the first magnetic conductor is superposed on the at least one first coil and a second surface of the first magnetic conductor is superposed on the at least one second coil. The second magnetic conductor is superposed on a surface of one of the at least one second coil wherein the surface is not superposed on the first magnetic conductor. The first magnetic conductor includes a hole, and a wire for winding a first coil of the at least one first coil extends from the first layer to the second layer via the hole, to wind a second coil of the at least one second coil.

The present invention further discloses an induction coil structure for a wireless charger. The induction coil structure includes a plurality of coils, (N−1) interlayer magnetic conductors and a bottom layer magnetic conductor. The plurality of coils are respectively disposed in a first layer to an $N^{th}$ layer among a plurality of layers of an induction coil. Each of the (N−1) interlayer magnetic conductors respectively disposed between two adjacent layers among the plurality of layers of the induction coil, and superposed between coils in the two adjacent layers. The bottom layer magnetic conductor is superposed on a surface of a coil in the $N^{th}$ layer wherein the surface is on an opposite side to the $(N-1)^{th}$ layer. Among the (N−1) interlayer magnetic conductors, a first interlayer magnetic conductor located between an $i^{th}$ layer and an $(i+1)^{th}$ layer of the induction coil includes a hole, and a wire for winding a first coil of the plurality of coils in the $i^{th}$ layer extends to the $(i+1)^{th}$ layer via the hole, to wind a second coil of the plurality of coils in the $(i+1)^{th}$ layer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
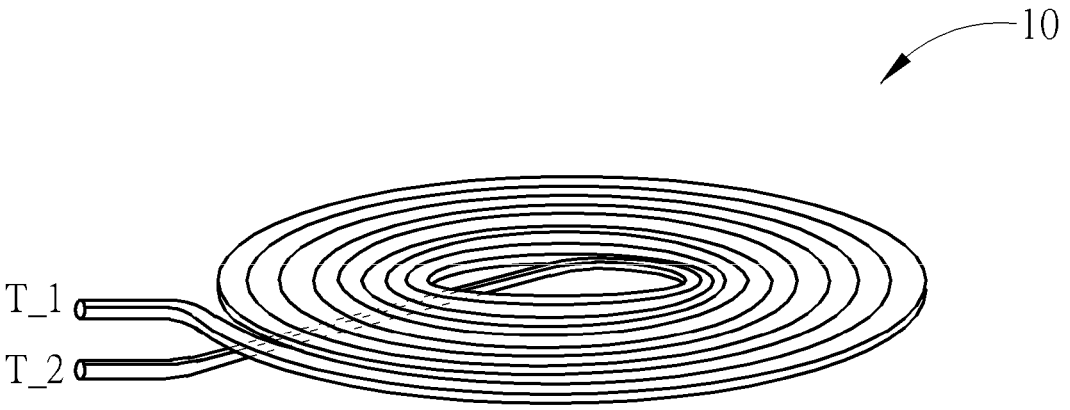
FIG. 1 is a schematic diagram of a coil.

Please refer to FIG. 1, which is a schematic diagram of a coil 10. As shown in FIG. 1, the coil 10 includes an induction surface formed by winding wires, a wire terminal T_1 and a wire terminal T_2. The wire terminal T_1 and the wire terminal T_2 may be connected in series or in parallel with a capacitor to form a resonance circuit. Signals and power are inputted to one or both of the two terminals of the resonance circuit via a power switch circuit. Internal impedance exists in the wire and the amount of the internal impedance would increase as the length of the wire increases. If the winding number of the coil increases for increasing the inductance value, the internal impedance may be elevated as well; this results in greater power loss.

The coil 10 is a common coil, which is winded from inside to outside and then glued together via hot melting or chemical solvents to form a spiral structure with a sheet shape. The surface of the sheet shape may be used for induction. However, with the structure of the coil 10, a terminal of the wire (e.g., the wire terminal T_1) is located at the outside of spiral, while the other terminal (e.g., the wire terminal T_2) may need to be pulled out from the center of the spiral along the surface of the sheet shape. The structure of the coil 10 may have at least two disadvantages. On one hand, if the pull-out part of the wire terminal T_2 and the induction object are on the same side, the wire terminal T_2 may generate a thickness as a wire width between the coil and the induction object, and thus the induction performance of the coil may be affected. If the pull-out part of the wire terminal T_2 is on the opposite side to the induction object, the coil would not be able to completely be glued to the magnetic conductor. On the other hand, since every part of the wire winding the coil may produce magnetic fields, these magnetic fields may interact with one another to deliver the power. However, the pull-out part of the wire terminal T_2 may form an additional magnetic field, which might affect the original magnetic field of the coil, and thus performance of induction is reduced.

Figure 2:
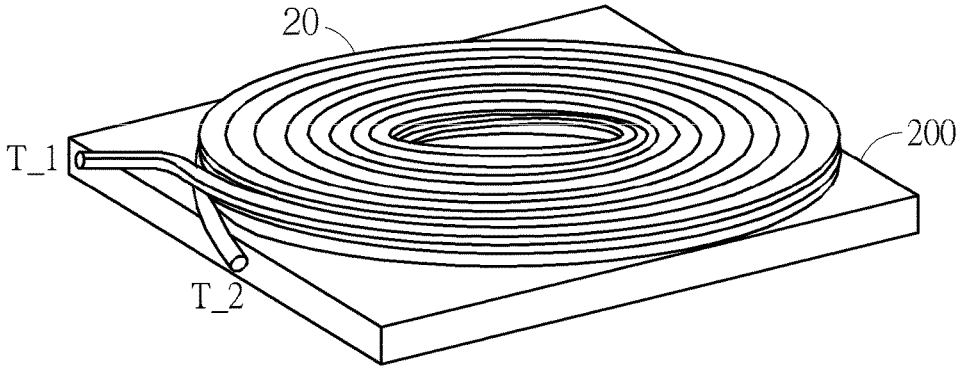
FIG. 2 is a schematic diagram of an α-type coil.

To solve the above problems, an α-type winding method has been introduced. Please refer to FIG. 2, which is a schematic diagram of an α-type coil 20. As shown in FIG. 2, the α-type coil 20 includes two layers of spiral structure superposed on each other. The wire enters the coil via the wire terminal T_1 and winds the first layer from outside to inside. After that, the wire enters the second layer inside the coil 20, and winds the second layer from inside to outside. Finally, the wire is drawn out via the wire terminal T_2 in the outer side of the second layer.

In FIG. 2, the α-type coil 20 is further superposed on a magnetic conductor 200. In general, the coil manufacturers may add a magnetic conductor on a side of the coil that does not perform induction, to improve the induction performance of the coil. The magnetic conductor may generate magnetic effects such as magnetic conduction, magnetic reflection and magnetic blocking. The magnetic conduction may increase the inductance of the coil, the magnetic reflection may reflect the power emitted by the coil to the side that is desired to perform induction, and the magnetic blocking may block the power emitted by the coil. If the magnetic conductor is superposed on the side that does not perform induction, the power of the coil may be able to be reflected to the induction object, in order to improve the induction performance and also prevent extra energy from being transmitted to the back end to cause ill effects on the back end circuit. In addition, when the magnetic conductor is superposed on the coil, the magnetic conductor may also transmit the thermal energy generated from the coil and thus heat dissipation effects can be achieved.

The present invention improves the α-type coil 20 to achieve a higher coverage of the magnetic conductor on the coil, in order to effectively realize the advantages of the magnetic conductor. In other words, the present invention may increase the inductance value and enhance the heat dissipation effect.

Figure 3A:
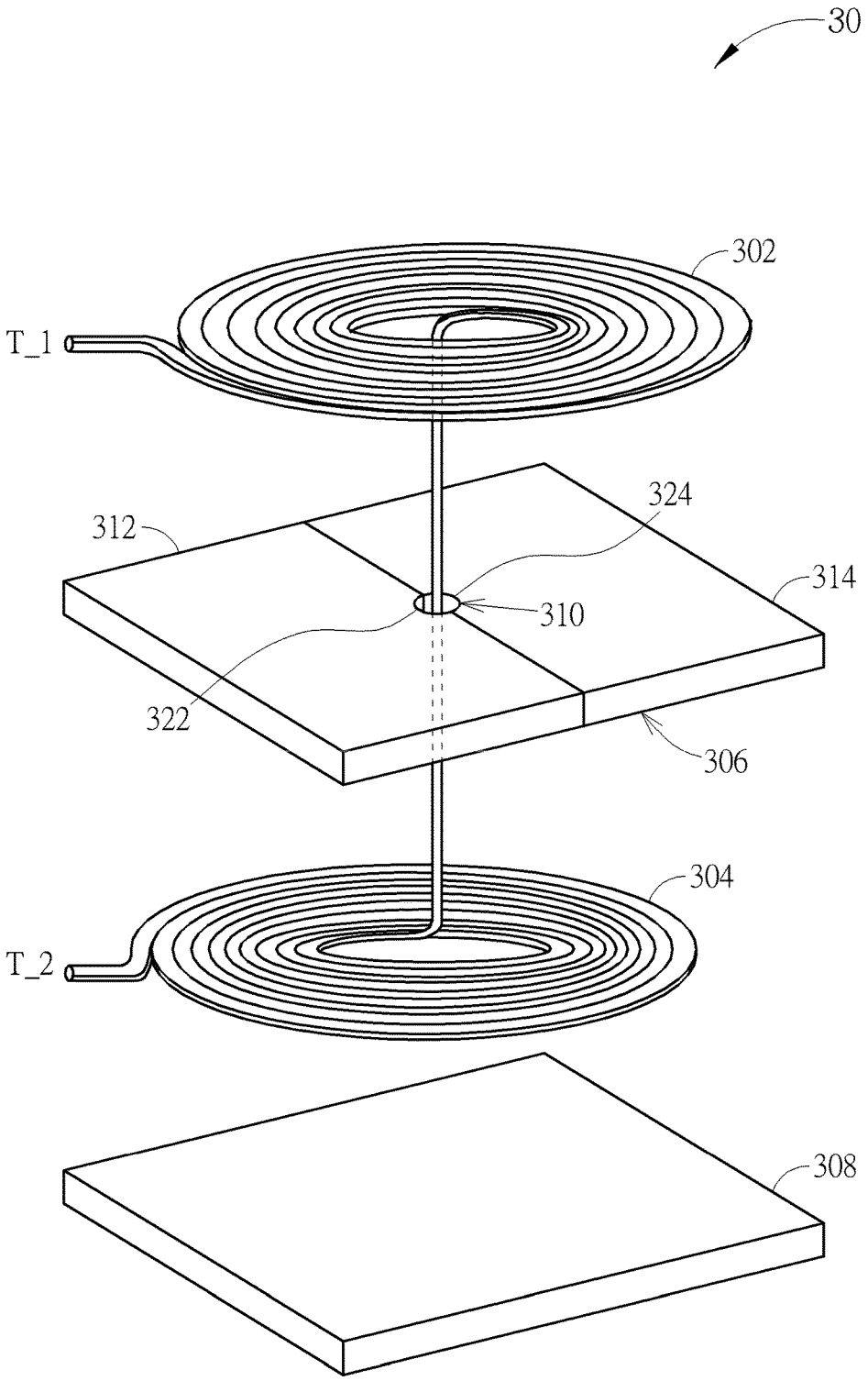
FIGS. 3A-3B are schematic diagrams of an induction coil according to an embodiment of the present invention.
Figure 3B:
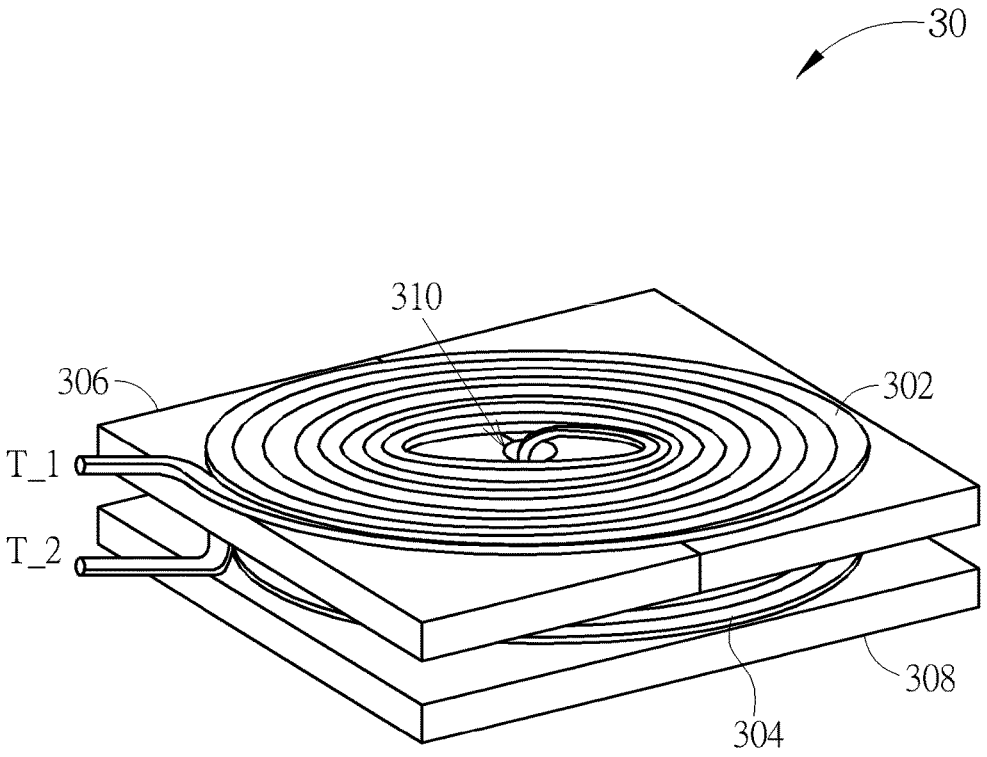

Please refer to FIGS. 3A-3B, which are schematic diagrams of an induction coil 30 according to an embodiment of the present invention. FIG. 3A illustrates the exploded view of the induction coil 30. As shown in FIG. 3A, the induction coil 30 includes an upper layer coil 302, a lower layer coil 304, an interlayer magnetic conductor 306 and a bottom layer magnetic conductor 308. In the induction coil 30, a wire terminal T_1 is located at the outer side of the upper layer coil 302, and a wire terminal T_2 is located at the outer side of the lower layer coil 304. The wire of the upper layer coil 302 and the wire of the lower layer coil 304 are connected at the inner side of the coils, and thus the problem such as a wire terminal of the coil 10 needing to be pulled out from the inner side of the coil may not exist. According to the structure of the induction coil 30, the upper layer coil 302 is disposed on the upper layer of the induction coil 30. There is not any blocking element above the upper layer coil 302 so that the upper layer coil 302 may be used for delivering energy. The lower layer coil 304 is disposed on the lower layer of the induction coil 30, which is covered between the interlayer magnetic conductor 306 and the bottom layer magnetic conductor 308. The interlayer magnetic conductor 306 is disposed between the upper layer coil 302 and the lower layer coil 304. More specifically, a surface of the interlayer magnetic conductor 306 is superposed on the upper layer coil 302 and another surface of the interlayer magnetic conductor 306 is superposed on the lower layer coil 304. The bottom layer magnetic conductor 308 is superposed on a surface of the lower layer coil 304 that is not superposed on the interlayer magnetic conductor 306. In addition, the interlayer magnetic conductor 306 may further include a hole 310. The wire for winding the upper layer coil 302 is extended from the upper layer to the lower layer via the hole 310, and then winded to generate the lower layer coil 304. The induction coil 30 after being combined in the above manner is shown in FIG. 3B.

In the induction coil 30, both the interlayer magnetic conductor 306 and the bottom layer magnetic conductor 308 are sheet-shaped. The areas of the interlayer magnetic conductor 306 and the bottom layer magnetic conductor 308 may be determined by the winding numbers and the wire width of the upper layer coil 302 and the lower layer coil 304. In general, areas of the upper surface and the lower surface of the interlayer magnetic conductor 306 are large enough to let the upper layer coil 302 and the lower layer coil 304 to be completely superposed on the upper surface and the lower surface of the interlayer magnetic conductor 306 respectively. The area of the bottom layer magnetic conductor 308 is also large enough to be completely superposed on the lower layer coil 304, in order to achieve a better coverage effect. Note that there is only one magnetic conductor superposed on the lower side of the α-type coil 20. Different from the α-type coil 20, according to the embodiment of the present invention, there are magnetic conductors superposed on both the upper side and lower side of the lower layer coil 304 of the induction coil 30 and the upper layer coil 302 is also superposed on the interlayer magnetic conductor 306 so that a higher degree of coverage is achieved on the induction coil 30. As a result, both the contact area of the coil and magnetic conductor and the coverage of the magnetic conductor on the coil are significantly increased. In addition, both the upper layer and the lower layer of the coil contact with the magnetic conductors. Therefore, the inductance value of the coil may be significantly increased and the heat dissipation effect of the magnetic conductors is also elevated.

In general, the manufacturing process of the induction coil is winding and shaping the coils first and then adding the magnetic conductors into the coils. During the winding process of the coil, the coil cannot easily go through the hole of the magnetic conductor. Therefore, multi-piece design may be applied to the magnetic conductor. For example, the interlayer magnetic conductor 306 in the induction coil 30 may be designed to be composed of sheet bodies 312 and 314. A side of the sheet body 312 includes a notch 322 and a side of the sheet body 314 includes a notch 324. After the coil is winded and shaped, the sheet bodies 312 and 314 may be embedded between the upper layer coil 302 and the lower layer coil 304 from different directions, respectively. The side of the sheet body 312 including the notch 322 and the side of the sheet body 314 including the notch 324 are connected to form the interlayer magnetic conductor 306. In this embodiment, the notch 322 and the notch 324 are aligned and combined together to form the hole 310. Further, the bottom layer magnetic conductor 308 does not require a hole, and thus the bottom layer magnetic conductor 308 can be realized by a single sheet body.

Among the above embodiments, the interlayer magnetic conductor 306 is designed to have two sheet bodies, but the present invention is not limited thereto. In other embodiments of the present invention, the interlayer magnetic conductor may be composed of three sheet bodies, four sheet bodies or more, or the interlayer magnetic conductor may be realized by a single sheet body. If the interlayer magnetic conductor has a single sheet body, the hole for passing the wire can be formed by directly drilling the interlayer magnetic conductor.

It is worth noting that both the upper layer and the lower layer in the induction coil 30 only include a single coil (i.e., the upper layer coil 302 and lower layer coil 304). According to the surface area of the interlayer magnetic conductor 306, the winding number of the upper layer coil 302 may equal the winding number of the lower layer coil 304. In other embodiments, the winding number of the upper layer coil 302 may be modified to be different from the winding number of the lower layer coil 304 so that the inductance values of the upper layer and the lower layer may be in balance. Specifically, since the coverage degree of the magnetic conductors on the lower layer coil is higher, the lower layer coil may easily have a higher inductance value. Thus, by adjusting the winding number of the upper layer coil to be greater than the winding number of the lower layer coil, the inductance value of the upper layer coil may be elevated to approach to or equal the inductance value of the lower layer coil. In other words, inductance balance between the upper layer and the lower layer may be achieved. In addition, in other embodiments, multiple coils may be disposed in a layer of the induction coil to further increase the flexibility in the allocation of inductance values.

Figure 4:
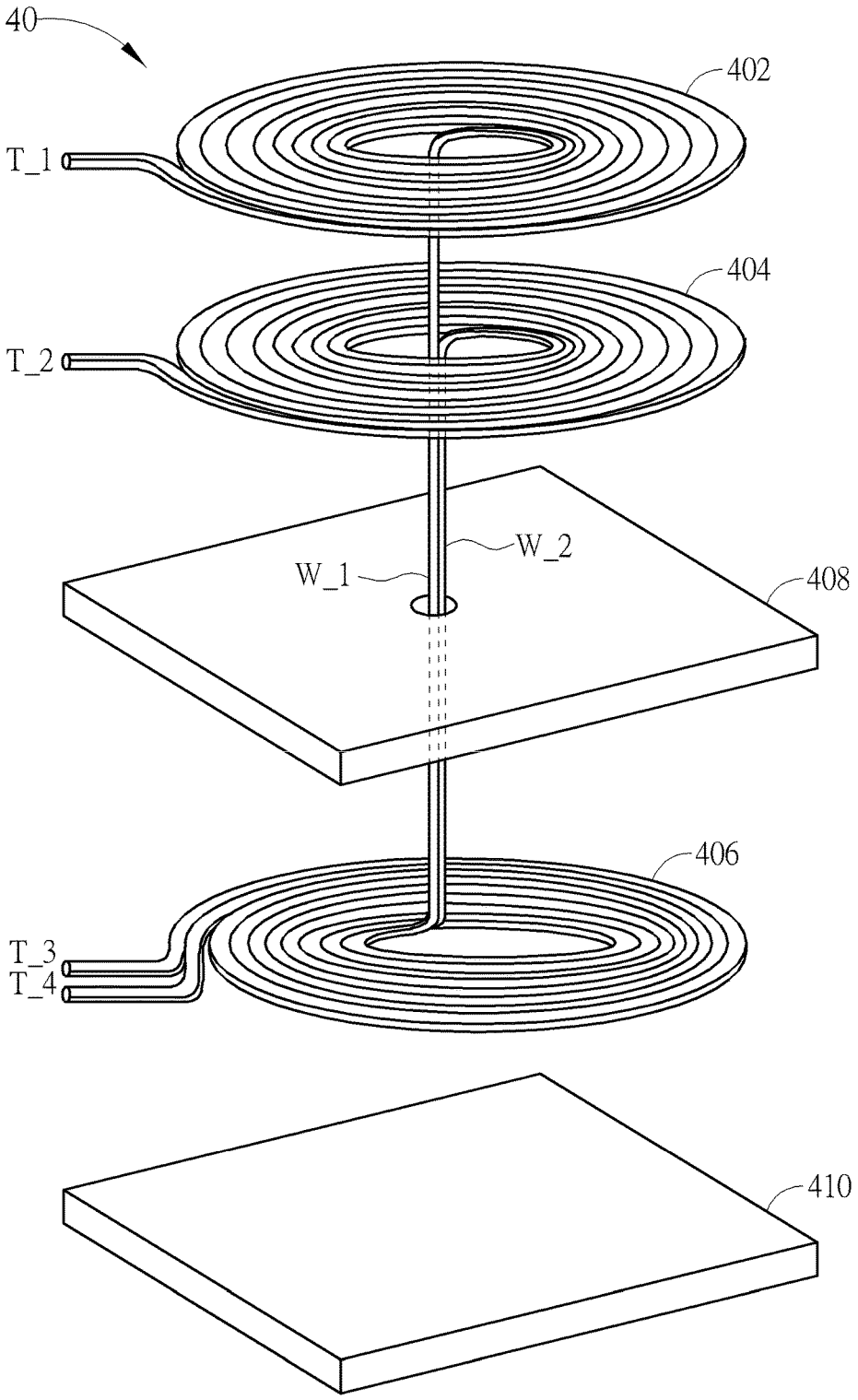
FIG. 4 is a schematic diagram of an exploded view of another induction coil according to an embodiment of the present invention.

Please refer to FIG. 4, which is a schematic diagram of an exploded view of another induction coil 40 according to an embodiment of the present invention. As shown in FIG. 4, the induction coil 40 includes upper layer coils 402 and 404, a lower layer coil 406, an interlayer magnetic conductor 408 and a bottom layer magnetic conductor 410. The major difference between the induction coil 40 and the induction coil 30 is that the upper layer of the induction coil 40 includes two upper layer coils 402 and 404. The winding numbers of the upper layer coils 402 and 404 may be the same and the upper layer coils 402 and 404 are superposed on each other. Specifically, the upper layer coil 404 is superposed on the interlayer magnetic conductor 408 and the upper layer coil 402 is superposed on the upper layer coil 404. The upper layer coils 402 and 404 are respectively formed by wires W_1 and W_2 with the same wire width winded from outside to inside. The wires W_1 and W_2 then go through the hole of the interlayer magnetic conductor 408 and extend to the lower layer. Subsequently, in the lower layer, the wires W_1 and W_2 may be combined horizontally and winded between the interlayer magnetic conductor 408 and the bottom layer magnetic conductor 410 to form the lower layer coil 406. Specifically, in the upper layer of the induction coil 40, the upper layer coils 402 and 404 are superposed on each other vertically. Thus, the total height of the upper layer coils is the sum of the wire width of the wire W_1 and the wire width of the wire W_2. In the lower layer of the induction coil 40, the wires W_1 and W_2 are attached to each other horizontally and winded around on the same plane, so that the height of the lower layer coil 406 equals the wire width of a single wire. If the winding area of the upper layer coils 402 and 404 equals the winding area of the lower layer coil 406, the winding number in the lower layer is a half of the winding number in the upper layer for either the wire W_1 or the wire W_2. In addition, the structure and preferred embodiments of the interlayer magnetic conductor 408 and the bottom layer magnetic conductor 410 are respectively similar to the structure and preferred embodiments of the interlayer magnetic conductor 306 and the bottom layer magnetic conductor 308 in FIG. 3A, and thus will not be redundantly described.

It is worth noting that the wire terminals T_1 and T_3 of the wire W_1 and the wire terminals T_2 and T_4 of the wire W_2 in the structure of the induction coil 40 are located at the outside of the coils, and thus the problem such as a wire terminal of the coil 10 needing to be pulled out from the inner side of the coil may not exist. In addition, since the winding number of the wires W_1 and W_2 in the upper layer are twice the winding number in the lower layer, larger inductance values may be generated by the coils in the upper layer. Furthermore, since only one surface of the upper layer coils 402 and 404 is superposed on the interlayer magnetic conductor 408 while both the upper surface and the lower surface of the lower layer coil 406 are respectively superposed on the interlayer magnetic conductor 408 and the bottom layer conductor 410, the enhancement of the inductance value generated by the magnetic conductor in the lower layer is greater than the enhancement of the inductance value generated by the magnetic conductor in the upper layer. As a result, the induction coil manufacturers may adjust the winding number of the coils and the placement of the magnetic conductors to let the inductance value in the upper layer and the inductance value in the lower layer to be similar or the same, in order to reach inductance balance. In addition, in the induction coil 40, the winding number in the lower layer coil is one half of the winding number in the upper layer coil, which leads to a benefit of lower internal impedance in the lower layer coil, and the high coverage degree of the magnetic conductor may prevent the inductance value in the lower layer coil from being reduced due to a fewer winding number.

The interlayer magnetic conductor and the bottom layer magnetic conductor of the present invention may be composed of a magnetic material with high magnetic permeability. The magnetic material may be a Mn—Zn core, a Ni—Zn core, an iron powder core, a molypermalloy powder (MPP) core, a sendust core, a ferrite core, a high flux core or other suitable magnetic material.

It is worth noting that one of the main spirits of the present invention is to provide an induction coil structure for a wireless charger. The wireless charger may be a supplying-end module or a receiving-end module of an induction type power supply system, which enjoys the benefit of increasing power transmission/reception performance via an excellent structure of the induction coil. By utilizing the induction coil structure of the present invention, the inductance value may be significantly increased without affecting the resistance value, or the resistance value may be significantly decreased while the inductance value still remains in a certain level, so that the performance of the induction coil may be enhanced. Those skilled in the art can make modifications and alternations accordingly. For example, the magnetic conductors of the present invention are realized by sheet bodies, where the shape of the surface of the sheet body may be a square, a rectangle, a circle or a polygon. As long as the magnetic conductor may cover the coil effectively, any shape of the sheet body may be applied. In addition, in the induction coil of the present invention, each layer may include an arbitrary number of the coils winded by using an arbitrary number of wires. The coils in each layer may be winded clockwise or counterclockwise according to the system requirements. The position and the placement of the coils are not limited to the position and the placement of the embodiments illustrated above. For any type of the induction coil, as long as a magnetic conductor is disposed between coils indifferent layers, the interlayer structures thereof should be considered as modifications and alterations within the scope of the present invention. In addition, among the above embodiments, all of the induction coils include two layers of coils, where the upper layer coil is used as an induction medium to contact an induction object, and the lower layer coil is used for contacting the magnetic conductor to increase the inductance value. In other embodiments, the induction coil may include more layers of coils to further increase the inductance value.

Figure 5:
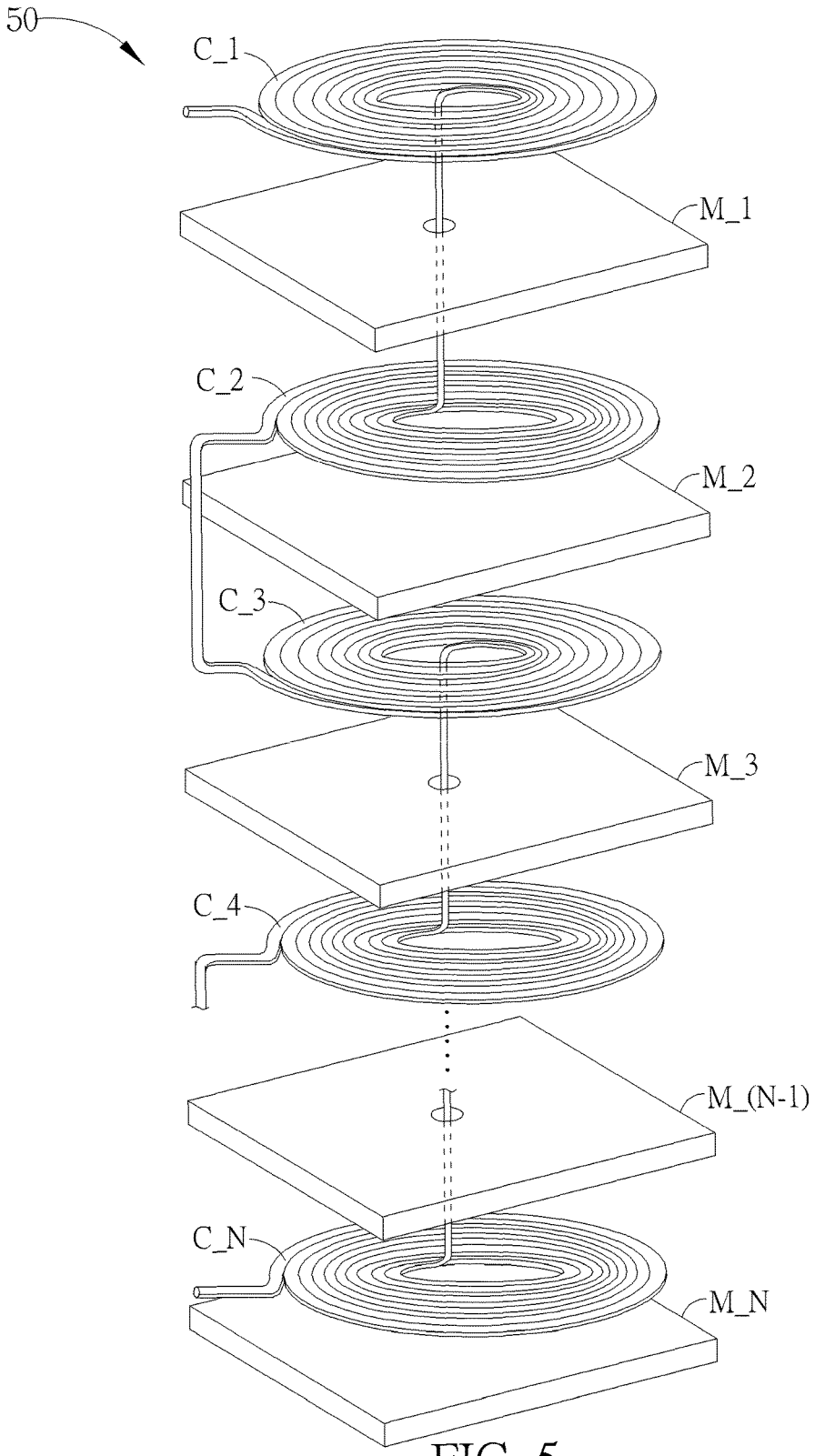
FIG. 5 is a schematic diagram of an exploded view of an N layer induction coil according to an embodiment of the present invention.

Please refer to FIG. 5, which is a schematic diagram of an exploded view of an N layer induction coil 50 according to an embodiment of the present invention. As shown in FIG. 5, the induction coil 50 includes N coils C_1-C_N, (N−1) interlayer magnetic conductors M_1-M_(N−1) and a bottom layer magnetic conductor M_N. The coils C_1-C_N are respectively disposed in a first layer to an $N^{th}$ layer, and each of the interlayer magnetic conductors M_1-M_(N−1) is respectively disposed between two adjacent layers for separation. Among the coils C_1-C_N, the upper and lower surfaces of almost all coils are superposed on the interlayer magnetic conductors, except that for the coil C_1 of the first layer, only the lower surface is superposed on the interlayer magnetic conductor M_1. As such, an excellent coverage effect is achieved. For the interlayer magnetic conductors M_1-M_(N−1), the upper and lower surfaces of each of the interlayer magnetic conductors M_1-M_(N−1) are superposed on the coils, while only the upper surface of the bottom layer magnetic conductor M_N is superposed on the coil C_N. Preferably, the coils C_1-C_N are formed by winding the same wire, and each of the coils C_1-C_N has the same winding number and the same area. The surface of each of the interlayer magnetic conductors M_1-M_(N−1) or the surface of the sheet bodies forming the interlayer magnetic conductors M_1-M_(N−1) are large enough to let the corresponding coils to be completely superposed on the interlayer magnetic conductors M_1-M_(N−1).

It is worth noting that if the wire of the induction coil 50 is winded from top to bottom and the wire terminal at the top is located at the outside of the coil, the coils in the odd layers (i.e., C_1, C_3, C_5, . . . ) are winded from outside to inside, and the coils in the even layer (i.e., C_2, C_4, C_6, . . . ) are winded from inside to outside. For example, in the first layer, the wire may be winded from outside to inside to form the coil C_1, then pass through the hole of the interlayer magnetic conductor M_1 and extend to the second layer, and then be winded from inside to outside to form the coil C_2 in the second layer. Subsequently, the wire needs to extend to the third layer via the outside of the interlayer magnetic conductor M_2, and then be winded from outside to inside to form the coil C_3 in the third layer, and so on.

As can be seen in the above descriptions, for the interlayer magnetic conductors superposed below the odd layers and above the even layers (i.e., M_1, M_3, M_5, . . . ), since the wire passes through the magnetic conductors via the inner side of the coil, these magnetic conductors should include holes for the wire to pass through. For the interlayer magnetic conductors superposed below the even layers and above the odd layers (i.e., M_2, M_4, M_6, . . . ), since the wire passes between the two layers via the outer side of the coil, the wire may pass through the magnetic conductors via the outer side of the interlayer magnetic conductors; in such a situation, the center of the interlayer magnetic conductor does not need to have a hole, or a hole may be allocated near the outer part of the coil for the wire to pass through. As a result, each of the interlayer magnetic conductors M_1-M_(N−1) may be determined to have a hole for the wire to pass through or not based on the requirements. In addition, each of the above interlayer magnetic conductors M_1-M_(N−1) may have two pieces, multi pieces or a single piece according to design requirements.

Preferably, the number of layers in the induction coil 50 may be designed to be an even number, (i.e., N is an even number), so that both the upper wire terminal and the lower wire terminal are located at the outside of the coil; this prevents the problem where the wire terminal needs to be pulled out from the inside of the coil.

To sum up, the present invention provides an induction coil structure for a wireless charger. According to the embodiments of the present invention, the magnetic conductor is able to be superposed between the coils in different layers so that the coverage degree of the magnetic conductors on the coils is elevated to enhance the inductance value of the induction coil; hence, the induction coil may have both the excellent inductance and resistance values. As a result, the inductance value may be significantly increased without affecting the resistance value, or the resistance value may be significantly decreased while the inductance value still remains in a certain level, so that the performance of the induction coil is enhanced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An induction coil structure for a wireless charger, comprising:

at least one first coil, disposed in a first layer of an induction coil;

at least one second coil, disposed in a second layer of the induction coil;

a first magnetic conductor, located between the at least one first coil and the at least one second coil, wherein a first surface of the first magnetic conductor is superposed on the at least one first coil and a second surface of the first magnetic conductor is superposed on the at least one second coil; and a second magnetic conductor, superposed on a surface of one of the at least one second coil wherein the surface is not superposed on the first magnetic conductor;

wherein the first magnetic conductor comprises a hole, and a wire for winding a first coil of the at least one first coil extends from the first layer to the second layer via the hole, to wind a second coil of the at least one second coil;

wherein the at least one first coil comprises two first coils, which have same winding numbers and are superposed on each other, and the at least one second coil comprises a single second coil, which is formed by attaching two wires respectively corresponding to the two first coils and winding the two wires on a same plane between the first magnetic conductor and the second magnetic conductor.

2. The induction coil structure of claim 1, wherein the first magnetic conductor comprises:

a first sheet body, of which a side comprises a first notch; and a second sheet body, of which a side comprises a second notch;

wherein the side of the first sheet body comprising the first notch and the side of the second sheet body comprising the second notch are connected to form the first magnetic conductor with a sheet shape, and the first notch and the second notch are combined together to form the hole.

3. The induction coil structure of claim 1, wherein areas of the first surface and the second surface of the first magnetic conductor are large enough to let the at least one first coil and the at least one second coil to be completely superposed on the first surface and the second surface of the first magnetic conductor respectively.

4. The induction coil structure of claim 1, wherein the second magnetic conductor comprises:

a sheet body, of which an area of a surface is large enough to let the at least one second coil to be completely superposed on the surface.

5. The induction coil structure of claim 1, wherein the first magnetic conductor and the second magnetic conductor are respectively a magnetic material with high magnetic permeability.

6. The induction coil structure of claim 5, wherein the magnetic material is a Mn—Zn core, a Ni—Zn core, an iron powder core, a molypermalloy powder (MPP) core, a sendust core, a ferrite core or a high flux core.

* * * * *